United States Patent [19]

Beavers

[11] Patent Number: 4,662,268

[45] Date of Patent: May 5, 1987

[54] COMBINATION PURGING AND VENTILATING BLOWER

[75] Inventor: Allan E. Beavers, Littleton, Colo.

[73] Assignee: T.A. Pelsue Company, Englewood, Colo.

[21] Appl. No.: 787,615

[22] Filed: Oct. 15, 1985

[51] Int. Cl.[4] ..... F24F 7/06

[52] U.S. Cl. ..... 98/39.1; 98/DIG. 7

[58] Field of Search ..... 98/39.1, 50, DIG. 7

[56] References Cited

U.S. PATENT DOCUMENTS

| | | | |
|---|---|---|---|
| 4,285,269 | 8/1981 | Pelsue et al. | 98/33.1 |
| 4,344,357 | 8/1982 | Mittelkotter | 98/DIG. 7 X |
| 4,515,071 | 5/1985 | Zach | 98/55 |

FOREIGN PATENT DOCUMENTS

| | | | |
|---|---|---|---|
| 354233 | 5/1961 | Switzerland | 98/DIG. 7 |

*Primary Examiner*—Harold Joyce

*Attorney, Agent, or Firm*—Edwin L. Spangler, Jr.

[57] ABSTRACT

A blower which is specifically designed not only to purge a workplace of foul air preparatory to it being entered by personnel but also to provide these people with adequate ventilation once they are inside, such a blower being characterized by a hollow generally cylindrically-shaped open-ended outer housing having an intake end at the rear thereof and a discharge end in front, a collapsible purging hose with its rear end attached inside the outer housing adjacent the intake end of the latter and extendable out through its discharge end into a workplace to be purged, a generally frustoconical inner housing having its larger diameter intake end spaced to the rear of the intake end of the outside housing while at the same time cooperating therewith when positioned inside thereof to define one or more air-aspirating ports therebetween as well as an annulus for the storage of the purging hose in collapsed condition, a blower attached to deliver air to the intake end of the inner housing and cooperate therwith when the purging hose is extended to aspirate air into the latter through the air-aspirating ports as well as deliver air thereto, and a ventilating hose attachable to the relatively smaller discharge end of the inner housing for ventilating the workplace previously purged when the purging hose is stowed in collapsed condition.

5 Claims, 2 Drawing Figures

COMBINATION PURGING AND VENTILATING BLOWER

Figure 1:
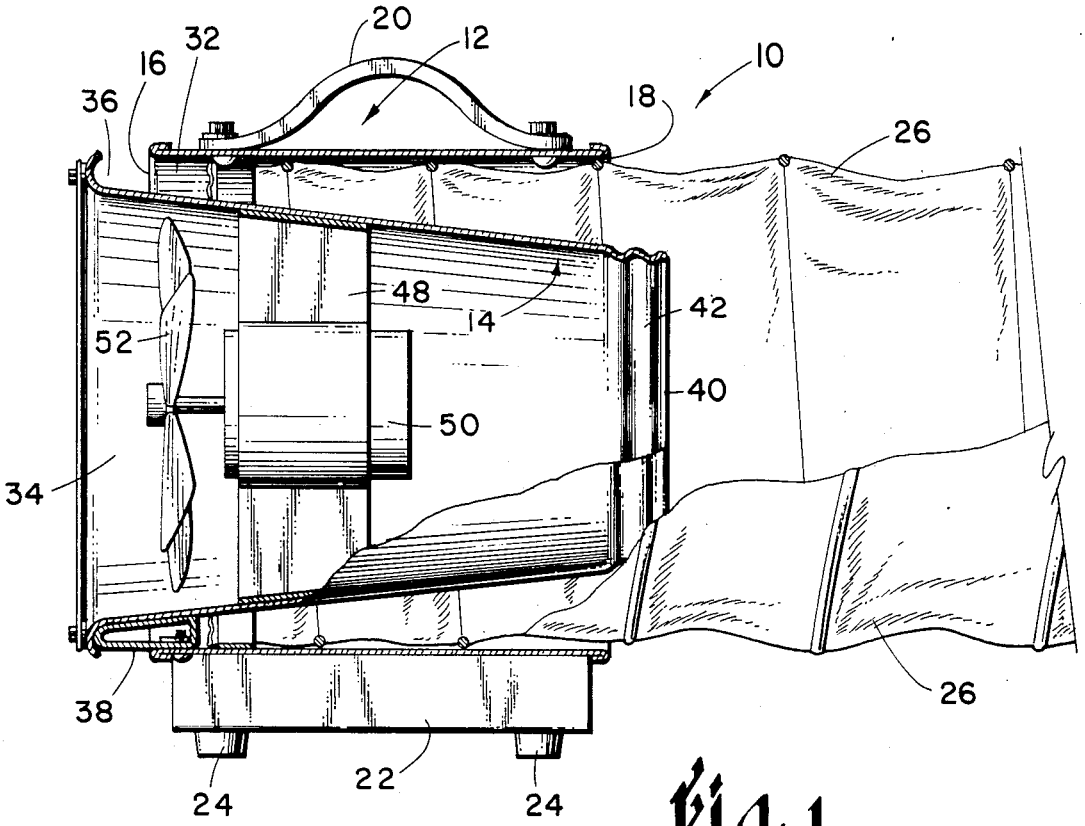

Underground installations in urban areas carry a variety of utilities such as, for example, telephone lines, gas lines, water lines and occasionally even power lines. Such installations are accessible at varying locations through manholes located on the surface. There is always a risk of the personnel entering these areas being exposed to foul air and even an explosive atmosphere; therefore, most cities have stringent ordinances requiring that they be purged in some fashion before any person is permitted to enter them. Some demand that the air be changed several times to insure that the risk of asphyxiation and explosion are absolutely minimal.

In the past, this has usually been handled by forced air blowers located on the surface that pipe the air underground through large diameter flexible pipes or hoses. These same blowers are oftentimes used for supplying the personnel working underground with ventilating air after the workplace has been purged; however, a single blower seldom has the capacity to carry out the purging operation efficiently and quickly, therefore, two or more of them are oftentimes operated at the same time to speed up the process. A second or a third one used just for purging purposes constitutes an unnecessary expense while taking up valuable storage space on the service truck. Also, since most of these blowers are driven by electric motors rather than gasoline engines, extra portable generating capacity is needed.

Actually, the portable blowers used for ventilation of subsurface workspaces are not particularly well-suited to the task of purging these same spaces of bad air. To begin with, they are generally designed to deliver a modest volume of fresh air at a somewhat elevated pressure when, for purging purposes, large volumes of air need to be introduced and the fact that the pressure is low is of little or no consequence.

Forced-air blowers are notoriously old in the art and they customarily consist of some kind of housing within which is mounted a bladed fan. The fan generally is so arranged within the housing as to suck ambient air in from the outside and deliver same into the workpiece. Such a fan is exemplified by the U.S. Patent to Miller, No. 2,008,965. Blower fans especially designed for the ventilation of confined spaces are also known in the art, one example of which being depicted in the U.S. patent to McDonald et al, No. 3,859,816. Equally well known are fans which supplement the supply of air ordinarily delivered to the workspace with ambient air aspirated from the atmosphere or other source thereof. Characteristic of the latter are the fans shown in the U.S. Patents to Davenport No. 2,544,379; Green et al No. 3,460,746; Teodorescu et al No. 4,002,110 and Zach No. 4,515,071. Certain of the aforementioned patents like Teodorescu utilize a venturi principle to speed up the air and aid in the aspiration of the supplemental air. Movement of air to and from a workspace through a flexible and collapsible conduit is, likewise, a feature well accepted in the ventilating art as is exemplified by U.S. Pat. No. 2,480,441 issued to Bingham. Even a collapsible conduit movable from a collapsed essentially inoperative condition to an extended operative one has been tried as exemplified by Christensen et al's U.S. Pat. No. 4,361,079.

A critical examination of this prior art will reveal that, insofar as applicant is aware, no one up until now has devised a combination purging and ventilating blower in which the collapsible purging hose is stowed during the ventilating mode in an annulus defined between two housings, one of which is sized to deliver air to the large diameter purging hose and the other to a smaller diameter ventilating hose. Moreover, when used in the purging mode, the large diameter purging hose is deployed and the smaller of the two housings functions as a venturi aspirating air into the larger collapsible conduit to supplement that air sucked by the fan into the aforesaid housing for ventilating purposes.

It has now been found in accordance with the teaching of the instant invention that the most desirable attributes of both a purging and a ventilating blower can, in fact, be combined into a single unique unit which, when set up in the purging mode, not only pushes air into the workspace using a conventional fan to do so but, additionally, relies upon the venturi action of one of its parts to aspirate in an extra quantity of air at the same time, all of which is delivered through a large diameter collapsible as well as flexible pipe. Then, in changing over to the ventilating mode from the purging mode, the large diameter pipe is collapsed and stowed in an annular storage compartment provided for this purpose between the outer housing and the inner one shaped like a venturi preparatory to attaching a smaller diameter ventilating hose to the outlet of the latter. A single electric motor drives the combination unit in both of the above-described operational modes and, therefore, no additional generating capacity or even an extra hookup is needed to accomplish both tasks. Moreover, the combination unit takes up essentially the same amount of storage and workspace as a ventilating unit by itself.

Accordingly, it is the principal object of the present invention to provide a novel combination ventilating and purging blower of a type particularly well-suited for use in both cleaning out foul air and supplying fresh air to underground workplaces.

A second objective of the invention herein disclosed and claimed is that of providing a dual-purpose blower which serves as its own storage compartment for the collapsible purging hose when not in use.

Another object is to provide a forced-air blower which relies upon the venturi principle to aspirate air into the apparatus so as to increase the volume of air available for purging purposes.

Still another objective of the within-described invention is the provision of a ventilating apparatus that is safe to use even in an explosive underground atmosphere due to the fact that the electric motor driving the fan always remains on the surface.

An additional object is to provide a portable electric blower that effectively replaces two conventional high pressure ventilating blowers when used in the purging mode thus conserving energy.

Further objects are to provide a forced air combination purging and ventilating blower which is compact, rugged, efficient, relatively lightweight, versatile and even decorative.

Figure 2:
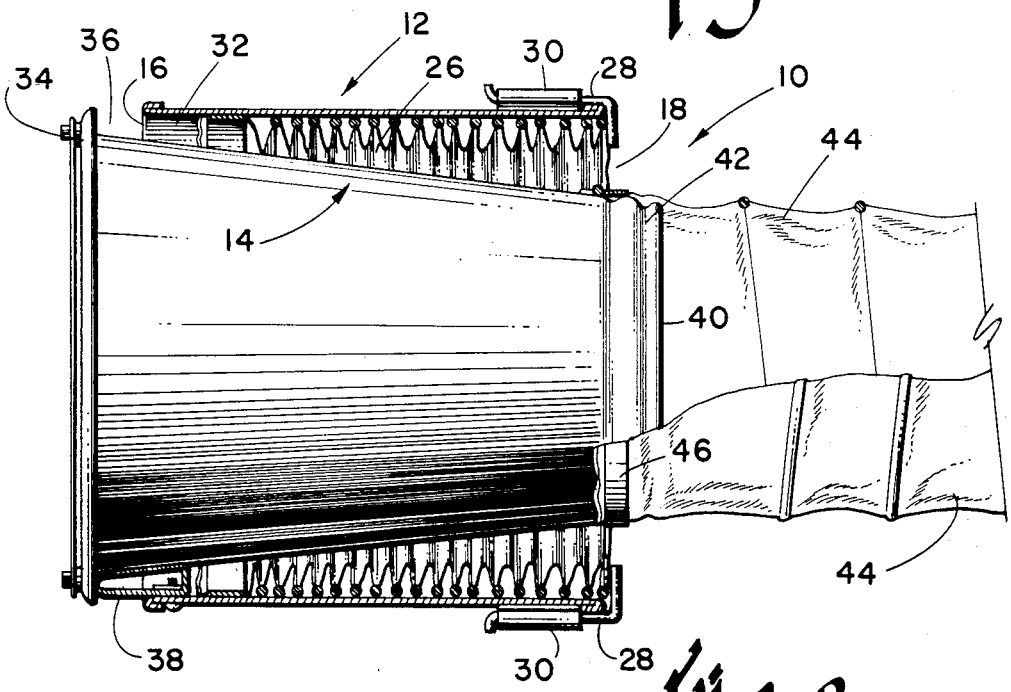

Other objects will be in part apparent and in part pointed out specifically hereinafter in connection with the description of the drawings that follows, and in which:

FIG. 1 is a side elevation showing the portable combination purging and ventilating blower set up in the purging mode, portions of both the outer and inner housings as well as the extended purging hose having been broken away to more clearly reveal the interior construction as well as conserve space; and, FIG. 2 is a top plan view to the same scale as FIG. 1 revealing the unit set up in the ventilating mode wherein the purging hose is seen in stowed condition with the ventilating hose attached to the outlet of the inner housing, portions of the latter as well as the outer housing, once again, having been shown broken away to both expose the interior construction and conserve space.

Referring next to the drawings for a detailed description of the present invention, reference numeral 10 has been chosen to broadly designate the combination forced-air purging and ventilating blower in its entirety while numerals 12 and 14 have been selected to similarly connote the outer and inner housings, respectively. Outer housing 12 can be seen to comprise a hollow cylindrical metal shell open at both its rear intake end 16 and its front discharge end 18. A carrying handle 20 can be seen in FIG. 1 attached atop the outer housing while a base 22 is fastened therebeneath and supported on rubber feet 24. In both FIGS. 1 and 2, a large diameter collapsible purging hose 26 can be seen attached inside the outer housing adjacent the rear intake end thereof. Its length is such that when extended as shown in FIG. 1, it will extend down into the underground workplace through an open manhole (not shown). In its collapsed inoperative condition shown in FIG. 2, on the other hand, the overall length of the purging hose is selected such that it will fit completely inside of the outer housing where L-shaped clips 28 releasably retain it in stowed position. These clips are rotatable between their latched and released positions within the tubular mountings 30 therefor that are welded or otherwise affixed to the outer surface of the outer housing 12 adjacent its discharge end 18.

Inner housing 14 is frustoconically shaped and sized to fit easily inside the outer housing 12 leaving an annular storage space 32 therebetween for the storage of the large diameter purging hose 26. In the particular form shown, the inner housing is somewhat longer than the outer one so that its rear intake end 34, which is approximately the same diameter as the corresponding end 16 of the outer housing, lies spaced behind the latter while cooperating therewith to leave air-intake ports 36 therebetween through which air is inspirated in a manner to be explained in detail presently. Mounting brackets 38 extending between the opposed surfaces of the inner and outer housings and located to the rear of the purging hose fasten the housings together so as to not interfere with either the stowage or deployment of this hose within the annulus 34.

The discharge end 40 of the smaller housing 14 is shown projecting slightly beyond the discharge end 18 of the outer housing where it is circumferentially ribbed as seen at 42 to receive the near end of the smaller diameter collapsible ventilating hose 44 to which it is detachably connected by a band 46. Inside the inner housing mounted on a suitable supporting bracket 49 is an electric-motor-driven fan 50 whose blades 52 suck air into the large diameter intake end 34 of the inner housing and blow it out through its smaller diameter discharge end 40 thus creating a venturi action effective to aspirate additional air into the outer housing through air-intake ports 36. Thus, when the system is set up in the purge mode of FIG. 1, a significant additional volume of air is aspirated into the outer housing 12 and delivered to the workplace through large diameter hose 26. By way of example, not only does the large diameter purging hose 26 have smaller friction losses than the small diameter one 44, when used in the manner of the present invention, it will deliver almost 40% more air into the workplace. Specifically, a 12 inch diameter purging hose will deliver in excess of 1300 cubic feet per minute (cfm) of air while an 8 inch diameter one connected to the outlet of the small housing will deliver only about 785 cfm when powered by a quarter horsepower blower. Admittedly, the ventilating air delivered by the smaller diameter hose 44 enters the workplace at a higher pressure than that issuing from the purge hose 26; however, in the purging as opposed to the ventilating operation, volume is the primary consideration, not pressure.

A unit of the type illustrated is fully portable and several have been constructed weighing only about 36 pounds when fitted with a 12 inch diameter purging hose 12 feet long. Stowage of the unit aboard a service truck is simple and results in a significant saving of space since those referred to above are only 14 inches long overall, 13 inches wide and 15 inches high. Also, for wintertime operation, these blowers can be coupled to an electric heater which heats the air before it enters the workplace when operated in the ventilating mode.

What is claimed is:

1. The portable combination forced-air purging and ventilating blower which comprises: a hollow open-ended outer housing having a rear end defining an air intake and a front end through which air is discharged; an open-ended inner housing mounted inside the outer housing cooperating therewith to define an annular storage compartment, said inner housing also having a rear air intake end spaced from the rear end of the outer housing cooperating with the latter to define at least one air-aspirating port, and said inner housing further having a forwardly-tapered configuration terminating in a discharge opening substantially smaller than its air intake end; a large diameter collapsible purging hose having a rear end attached adjacent the rear end of the outer housing for movement from a collapsed condition housed wholly within the annular storage compartment to an extended operative position projecting forwardly therebeyond; a blower fan mounted inside the inner housing operative upon actuation to suck air into the latter through said rear air intake end and blow same forwardly out through the discharge opening in the forward end thereof, the tapered configuration of said inner housing defining a venturi effective to aspirate additional air in through the air-inspirating port and deliver it along with the air sucked in through said air intake into the large diameter purging hose when extended; and, a smaller diameter ventilating hose connectable to the discharge end of the small housing to deliver air sucked in through said intake end to a remote workplace when the large diameter purging hose is collapsed and stowed in its storage compartment.

2. The portable combination forced-air purging and ventilating blower as set forth in claim 1 in which: the outer housing is substantially cylindrical and the inner housing is substantially frustoconical.

3. The portable combination forced-air purging and ventilating blower as set forth in claim 1 in which: openable closure means releasably latch the large diameter purging hose in collapsed condition inside the storage compartment.

4. The portable combination forced-air purging and ventilating blower as set forth in claim 1 in which: the air-inspirating port substantially encircle the storage compartment at the rear end thereof.

5. The portable combination forced-air purging and ventilating blower as set forth in claim 1 in which: the rear ends of the inner and outer housings are shaped and arranged such that the ventilating air sucked into the inner housing through the intake end enters substantially axially while the air aspirated in through the air-inspirating port enters substantially radially.

* * * * *